US008846826B2

(12) United States Patent
Tarao

(10) Patent No.: US 8,846,826 B2
(45) **Date of Patent: *Sep. 30, 2014**

(54) GOLF BALL

(75) Inventor: Toshiyuki Tarao, Kobe (JP)

(73) Assignee: SRI Sports Limited, Kobe (JP)

( * ) Notice: Subject to any disclaimer, the term of this patent is extended or adjusted under 35 U.S.C. 154(b) by 916 days.

This patent is subject to a terminal disclaimer.

(21) Appl. No.: 12/418,179

(22) Filed: Apr. 3, 2009

(65) Prior Publication Data

US 2009/0264221 A1 Oct. 22, 2009

(30) Foreign Application Priority Data

Apr. 18, 2008 (JP) ..... 2008-109169

(51) Int. Cl.

| | |
|---|---|
| ***A63B 37/12*** | (2006.01) |
| ***A63B 37/00*** | (2006.01) |
| ***C08G 18/83*** | (2006.01) |
| ***C08L 75/04*** | (2006.01) |
| ***C08L 75/00*** | (2006.01) |
| ***A63B 45/00*** | (2006.01) |

(52) U.S. Cl.

CPC ..... *A63B 37/0003* (2013.01); *A63B 37/0024* (2013.01); *A63B 37/0031* (2013.01); *A63B 45/00* (2013.01)

USPC ..... 525/458; 525/457; 473/378

(58) Field of Classification Search

None

See application file for complete search history.

(56) References Cited

U.S. PATENT DOCUMENTS

| | | | | |
|---|---|---|---|---|
| 3,395,109 | A | 7/1968 | Molitor et al. | |
| 3,989,568 | A | 11/1976 | Isaac | |
| 4,123,061 | A | 10/1978 | Dusbiber | |
| 4,248,432 | A | 2/1981 | Hewitt et al. | |
| 4,347,338 | A | 8/1982 | Torii et al. | |
| 5,334,673 | A | 8/1994 | Wu | |
| 5,553,852 | A | 9/1996 | Higuchi et al. | |
| 5,947,844 | A | 9/1999 | Shimosaka et al. | |
| 6,123,534 | A | 9/2000 | Kasashima et al. | |
| 6,123,628 | A | 9/2000 | Ichikawa et al. | |
| 6,258,310 | B1 * | 7/2001 | Sardanopoli et al. | 264/211.23 |
| 6,346,053 | B1 | 2/2002 | Inoue et al. | |
| 6,368,238 | B1 | 4/2002 | Kasashima et al. | |
| 6,582,325 | B1 | 6/2003 | Ichikawa et al. | |
| 6,660,824 | B2 | 12/2003 | Yokota | |
| 6,685,456 | B2 | 2/2004 | Sajima | |
| 6,686,436 | B2 | 2/2004 | Iwami | |
| 6,747,100 | B2 | 6/2004 | Ichikawa et al. | |
| 6,750,299 | B2 | 6/2004 | Ichikawa et al. | |
| 6,764,415 | B2 | 7/2004 | Ichikawa et al. | |
| 6,806,323 | B2 | 10/2004 | Ichikawa et al. | |
| 6,966,850 | B2 | 11/2005 | Watanabe et al. | |
| 6,992,145 | B2 | 1/2006 | Ichikawa et al. | |
| 7,052,415 | B2 | 5/2006 | Sasaki et al. | |
| 7,090,799 | B2 | 8/2006 | Takesue et al. | |
| 7,140,979 | B2 | 11/2006 | Umezawa et al. | |
| 7,322,892 | B1 | 1/2008 | Watanabe | |
| 7,335,115 | B1 | 2/2008 | Watanabe et al. | |
| 7,344,454 | B2 | 3/2008 | Umezawa et al. | |
| 8,017,690 | B2 | 9/2011 | Hirau et al. | |
| 2002/0094886 | A1 | 7/2002 | Sajima | |
| 2003/0064831 | A1 | 4/2003 | Ichikawa et al. | |
| 2003/0064832 | A1 | 4/2003 | Ichikawa et al. | |
| 2003/0064833 | A1 | 4/2003 | Ichikawa et al. | |
| 2003/0064834 | A1 | 4/2003 | Ichikawa et al. | |
| 2003/0064835 | A1 | 4/2003 | Ichikawa et al. | |
| 2004/0106473 | A1 | 6/2004 | Hayashi et al. | |
| 2004/0106474 | A1 | 6/2004 | Hayashi et al. | |
| 2004/0138010 | A1 | 7/2004 | Ichikawa et al. | |
| 2004/0142771 | A1 | 7/2004 | Sajima et al. | |
| 2005/0113188 | A1 | 5/2005 | Sajima | |
| 2005/0181891 | A1 | 8/2005 | Umezawa et al. | |
| 2005/0187038 | A1 | 8/2005 | Sasaki et al. | |
| 2005/0202904 | A1 | 9/2005 | Takesue et al. | |
| 2006/0270492 | A1 | 11/2006 | Higuchi et al. | |
| 2006/0276596 | A1 | 12/2006 | Hayashi et al. | |
| 2007/0010351 | A1 | 1/2007 | Umezawa et al. | |
| 2007/0129174 | A1 | 6/2007 | Higuchi | |
| 2007/0142127 | A1 * | 6/2007 | Tarao | 473/371 |
| 2008/0161134 | A1 * | 7/2008 | Tarao | 473/378 |
| 2009/0111608 | A1 | 4/2009 | Watanabe et al. | |
| 2009/0124420 | A1 | 5/2009 | Kamino et al. | |
| 2009/0124421 | A1 * | 5/2009 | Hirau et al. | 473/374 |
| 2009/0124430 | A1 | 5/2009 | Hirau et al. | |
| 2009/0221387 | A1 * | 9/2009 | Ohama et al. | 473/383 |

(Continued)

FOREIGN PATENT DOCUMENTS

| | | |
|---|---|---|
| JP | 51-74726 | 6/1976 |
| JP | 58-2063 B2 | 1/1983 |

(Continued)

OTHER PUBLICATIONS

Japanese Office Action with the English translation dated Nov. 8, 2011, for Application No. 2007-190111.

Japanese Office Action with the English translation dated Nov. 8, 2011, for Application No. 2007-190112.

Japanese Office Action with the English translation dated Nov. 8, 2011, for Application No. 2007-291126.

Japanese Office Action, dated Aug. 16, 2011, for Japanese Application No. 2007-190111.

Japanese Office Action, dated Aug. 16, 2011, for Japanese Application No. 2007-190112.

US Notice of Allowance, dated May 10, 2011. for U.S. Appl. No. 12/289,957.

US Office Action, dated Apr. 27, 2011, for U.S. Appl. No. 12/289,953.

US Office Action, dated Apr. 29, 2011, for U.S. Appl. No. 12/289,956.

(Continued)

*Primary Examiner* — David Buttner

(74) *Attorney, Agent, or Firm* — Birch, Stewart, Kolasch & Birch, LLP

(57) ABSTRACT

The object of the present invention is to provide a golf ball having superior abrasion resistance, durability and spin performance. The present invention provides a golf ball of the present invention has a core and a cover, wherein the cover is formed from a cover composition that contains, as a resin component, a thermoplastic polyurethane (A) and a urethane prepolymer (B) having two or more isocyanate groups.

15 Claims, No Drawings

(56) References Cited

U.S. PATENT DOCUMENTS

| | | | |
|---|---|---|---|
| 2009/0226122 | A1 | 9/2009 | Schroeder |
| 2009/0247326 | A1 | 10/2009 | Ohama et al. |
| 2009/0247328 | A1 | 10/2009 | Kamino et al. |

FOREIGN PATENT DOCUMENTS

| | | | |
|---|---|---|---|
| JP | 7-24085 | A | 1/1995 |
| JP | 2662909 | B2 | 6/1997 |
| JP | 9-215778 | A | 8/1997 |
| JP | 10-99469 | A | 4/1998 |
| JP | 11-89967 | A | 4/1999 |
| JP | 11-137727 | A | 5/1999 |
| JP | 11-178949 | A | 7/1999 |
| JP | 2000-279553 | A | 10/2000 |
| JP | 2002-159598 | A | 6/2002 |
| JP | 2002-200196 | A | 7/2002 |
| JP | 2002-263219 | A | 9/2002 |
| JP | 2002-336378 | A | 11/2002 |
| JP | 2002-336379 | A | 11/2002 |
| JP | 2002-336380 | A | 11/2002 |
| JP | 2002-336381 | A | 11/2002 |
| JP | 2002-336386 | A | 11/2002 |
| JP | 2003-764 | A | 1/2003 |
| JP | 2003-70936 | A | 3/2003 |
| JP | 2004-16583 | A | 1/2004 |
| JP | 2004-97581 | A | 4/2004 |
| JP | 2004-180793 | A | 7/2004 |
| JP | 2004-180797 | A | 7/2004 |
| JP | 2004-305755 | A | 11/2004 |
| JP | 2005-224514 | A | 8/2005 |
| JP | 2005-230375 | A | 9/2005 |
| JP | 2005-253962 | A | 9/2005 |
| JP | 2006-344 | A | 1/2006 |
| JP | 2007-159997 | A | 6/2007 |
| JP | 2009-201896 | A | 9/2009 |
| JP | 2009-226115 | A | 10/2009 |
| JP | 2009-226122 | A | 10/2009 |

OTHER PUBLICATIONS

US Office Action, dated Aug. 31, 2010, for U.S. Appl. No. 12/003,598.

US Office Action, dated Feb. 22, 2011, for U.S. Appl. No. 12/366,415.

US Office Action, dated Feb. 23, 2011, for U.S. Appl. No. 12/003,598.

US Office Action, dated Jun. 2, 2011, for U.S. Appl. No. 12/003,598.

Japanese Office Action for Japanese Application No. JP2008-109169 dated Mar. 13, 2012.

Japanese Office Action with the English translation dated Aug. 21, 2012, for Application No. 2007-291126.

US Office Action for U.S. Appl. No. 12/003,598 dated May 7, 2012.

* cited by examiner

GOLF BALL

FIELD OF THE INVENTION

The present invention relates to a golf ball, and more particularly to an improvement in abrasion resistance, durability and spin performance of a golf ball having a urethane cover.

DESCRIPTION OF THE RELATED ART

Ionomer resins and polyurethanes are used as a base resin of a golf ball cover. Although covers that contain ionomer resins are widely used because of their excellent durability, it has been indicated that they have inferior abrasion resistance, due to high rigidity and hardness, and inferior controllability, due to insufficient spin performance. On the other hand, polyurethanes are used as a base resin of a golf ball cover because the usage of polyurethanes improves abrasion resistance and spin performance when compared to ionomer resins.

Polyurethanes are classified into two categories; a thermosetting polyurethane and a thermoplastic polyurethane. Using the thermosetting polyurethane as a cover material may provide a golf ball with superior abrasion resistance, however, there is a problem that the manufacturing process to obtain a golf ball becomes complicated. Furthermore, a golf ball using the thermoplastic polyurethane as a cover material has insufficient abrasion resistance and durability when compared to a golf ball that contains the thermosetting polyurethane as a cover.

As an improved technology for the thermoplastic polyurethane, for example, Patent document 1 discloses a method for manufacturing a thermosetting polyurethane molded article. In this manufacturing method, a compound having two or more isocyanate groups at the terminals thereof is blended in a thermoplastic resin that does not react with the isocyanate groups, and the obtained mixture is blended with a thermoplastic polyurethane resin, and then this blended material is placed in a molding machine for molding.

Furthermore, Patent documents 2 to 8 disclose an improved technology for a cover containing a thermoplastic polyurethane. Patent document 2 discloses a solid golf ball that includes a solid core and a cover which covers the solid core, wherein a resin component that forms the cover contains, as the main component, a reaction product of a thermoplastic polyurethane elastomer and a blocked isocyanate. Furthermore, Patent documents 3 to 7 disclose golf balls having a cover formed from a composition that contains a thermoplastic polyurethane material and an isocyanate mixture obtained by dispersing; an isocyanate compound that has two or more isocyanate groups as functional groups within one molecule, in a thermoplastic resin that substantially does not react with an isocyanate group.

Patent document 8 discloses a golf ball having a cover that contains a mixture of the following as the main component: a thermoplastic resin composition that is modified by a functional group which has reactivity with an isocyanate group, and the thermoplastic resin composition is selected from a group consisting of a thermoplastic block copolymer, a polyester based elastomer, a polyamide based elastomer, and a polyolefin; an isocyanate compound or an isocyanate mixture having two or more isocyanate groups as functional groups within the molecule thereof; and a thermoplastic polyurethane elastomer.

Patent document 1: Japanese Patent Publication No. S58-2063 B

Patent document 2: Japanese Patent Publication No. H11-178949 A

Patent document 3: Japanese Patent Publication No. 2002-336378 A

Patent document 4: Japanese Patent Publication No. 2002-336379 A

Patent document 5: Japanese Patent Publication No. 2002-336380 A

Patent document 6: Japanese Patent Publication No. 2002-336381 A

Patent document 7: Japanese Patent Publication No. 2002-336386 A

Patent document 8: Japanese Patent Publication No. 2005-253962 A

SUMMARY OF THE INVENTION

When a low molecular weight polyisocyanate is used as disclosed in patent documents 1 to 8, there is a problem that the improvement effects in abrasion resistance and durability are small, because a cover obtained by crosslinking becomes hard.

Furthermore, handling of the isocyanate compound is difficult in the embodiment described in patent document 2, because the isocyanate compound is inactivated by moisture contained in air. In a technique which uses a polyisocyanate mixture obtained by dispersing a bifunctional isocyanate compound into a thermoplastic resin as specifically disclosed in patent documents 3 to 8, since the thermoplastic resin serves as an impurity, the resultant cover does not always have sufficient abrasion resistance because of a low crosslink density. Further, when the amount of the polyisocyanate mixture is increased in order to enhance the crosslink density of the cover, the amount of the thermoplastic resin which causes inferior abrasion resistance also increases, resulting in a problem that the obtained cover ends up having further reduced abrasion resistance.

The present invention has been made in view of the above circumstances, and the object of the present invention is to provide a golf ball with superior abrasion resistance, durability, and spin performance.

The present invention provides a golf ball which comprises a core and a cover, and the cover is formed from a cover composition that contains, as a resin component, a thermoplastic polyurethane (A) and a urethane prepolymer (B) having two or more isocyanate groups.

By using the thermoplastic polyurethane (A) and the urethane prepolymer (B), the crosslinking reaction can be suppressed during the cover molding and promoted after the cover molding. Thus, the abrasion resistance and durability of the cover can be improved without reducing golf ball productivity.

The cover composition preferably contains, as a resin component, a reaction mixture (A+B) obtained by melt-mixing the thermoplastic polyurethane (A) and the urethane prepolymer (B). The reaction mixture (A+B) is preferably obtained by mixing the urethane prepolymer (B) in a range from 1 part to 50 parts by mass with respect to 100 parts by mass of the thermoplastic polyurethane (A).

The temperature difference ($T_{A+B}-T_A$) between the flow beginning temperature ($T_{A+B}$) of the reaction mixture (A+B) and the flow beginning temperature ($T_A$) of the thermoplastic polyurethane (A) is preferably in a range from −5° C. to 40° C. inclusive. The ratio ($\eta_{A+B}/\eta_A$) of the melt viscosity ($\eta_{A+B}$) of the reaction mixture (A+B) to the melt viscosity ($\eta_A$) of the thermoplastic polyurethane (A) is preferably in a range from 0.7 to 12.0 inclusive.

The number average molecular weight of the polyol component constituting the urethane prepolymer (B) is preferably 650 or more. The slab hardness of the cover composition is preferably in a range from 20 to 60 inclusive in Shore D hardness.

According to the present invention, a golf ball having the superior abrasion resistance, durability and spin performance can be obtained.

DESCRIPTION OF THE PREFERRED EMBODIMENT

A golf ball of the present invention comprises a core and a cover, and the cover is formed from a cover composition that contains, as a resin component, a thermoplastic polyurethane (A) and a urethane prepolymer (B) having two or more isocyanate groups.

First, the thermoplastic polyurethane (A) will be explained. The thermoplastic polyurethane (A) used in the present invention is not particularly limited, as long as it has a plurality of urethane bonds in a molecule and exhibits thermoplasticity. For example, the thermoplastic polyurethane is a reaction product obtained by reacting a polyisocyanate with a high molecular weight polyol to form urethane bonds in a molecule thereof, where necessary, obtained by further carrying out a chain extension reaction with a chain extender such as a low-molecular weight polyol and a low-molecular weight polyamine.

The polyisocyanate component, which constitutes the thermoplastic polyurethane (A), is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene-diisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). The polyisocyanate may be used either alone or as a mixture of at least two of them.

In view of improving the abrasion-resistance, the aromatic polyisocyanate is preferably used as the polyisocyanate component of the thermoplastic polyurethane (A). A use of the aromatic polyisocyanate improves the mechanical property of the obtained polyurethane and provides the cover with the excellent abrasion-resistance. In addition, in view of improving the weather resistance, as the polyisocyanate component of the thermoplastic polyurethane (A), a non-yellowing type polyisocyanate such as TMXDI, XDI, HDI, $H_6$XDI, IPDI, $H_{12}$MDI and NBDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

The polyol component constituting the thermoplastic polyurethane (A) is not particularly limited as long as it has a plurality of hydroxyl groups, and such examples include a low-molecular weight polyol and a high-molecular weight polyol. Examples of the low-molecular weight polyol may include a diol such as ethylene glycol, diethylene glycol, triethylene glycol, propanediol (e.g., 1,2-propanediol, 1,3-propanediol, and 2-methyl-1,3-propanediol), dipropylene glycol, butanediol (e.g., 1,2-butanediol, 1,3-butanediol, 1,4-butanediol, 2,3-butanediol, and 2,3-dimethyl-2,3-butanediol), neopentyl glycol, pentanediol, hexanediol, heptanediol, octanediol, 1,6-cyclohexanedimethylol, an aniline diol, and bisphenol A diol; a triol such as glycerin, trimethylol propane, and hexanetriol; a tetraol or a hexanol such as pentaerythritol and sorbitol. Examples of the high-molecular weight polyol include a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. The above polyols may be used alone or as a mixture of at least two of them.

A number average molecular weight of the high-molecular weight polyol is preferably, without limitation, for example, 400 or more, more preferably 1,000 or more. If the number average molecular weight of the high-molecular weight polyol is too small, the resultant polyurethane becomes too hard and the shot feeling of the golf ball deteriorates. The upper limit of the number average molecular weight of the high molecular weight polyol is not particularly limited, and it is preferably 10,000, more preferably 8,000. The number average molecular weight of the polyol component can be measured by Gel permeation Chromatography using two columns of TSK-GEL SUPREH 2500 (TOSOH Corporation) as a column, polystyrene as a standard material, and tetrahydrofuran as an eluate.

The polyamine component that constitutes the thermoplastic polyurethane where necessary may include any polyamine, as long as it has at least two amino groups. The polyamine includes an aliphatic polyamine such as ethylenediamine, propylenediamine, butylenediamine, and hexamethylenediamine, an alicyclic polyamine such as isophoronediamine, piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having at least two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane or the derivatives thereof.

The thermoplastic polyurethane (A) has no limitation on the constitutional embodiments thereof. Examples of the constitutional embodiments are the embodiment where the polyurethane consists of the polyisocyanate component and the high-molecular weight polyol component; the embodiment where the polyurethane consists of the polyisocyanate component, the high-molecular weight polyol component and the low-molecular weight polyol component; and the embodiment where the polyurethane consists of the polyisocyanate component, the high-molecular weight polyol component, the low-molecular weight polyol component, and the polyamine component; and the embodiment where the polyurethane consists of the polyisocyanate component, the high-molecular weight polyol component and the polyamine component.

The slab hardness of the thermoplastic polyurethane (A) in Shore D hardness is preferably 15 or more, and more preferably 17 or more, and preferably 50 or less, and more preferably 45 or less, and even more preferably 42 or less. If the hardness of the thermoplastic polyurethane (A) is too small, a spin amount at a driver shot may increase. Furthermore, if the hardness of the thermoplastic polyurethane (A) is too large, a spin amount at an approach wedge shot may become too small. Specific examples of the thermoplastic polyurethane (A) include Elastollan (registered trademark) XNY85A10, XNY90A, XNY97A, and ET890, which are all manufactured by BASF Japan Co., Ltd.

The number average molecular weight of the thermoplastic polyurethane (A) is, for example, preferably 20,000 or more, and more preferably 30,000 or more, and even more preferably 40,000 or more, and preferably 200,000 or less, and more preferably 150,000 or less, and even more preferably 100,000 or less. If the number average molecular weight of the thermoplastic polyurethane (A) is 20,000 or more, the abrasion resistance of the resultant golf ball can be improved even more. On the other hand, if the number average molecular weight of the thermoplastic polyurethane (A) is 200,000 or less, since the cover composition has the good fluidity, and the moldability of the cover becomes good.

The flow beginning temperature ($T_A$) of the thermoplastic polyurethane (A) is preferably 100° C. or higher, and more preferably 110° C. or higher, and even more preferably 120° C. or higher, and preferably 210° C. or lower, and more preferably 205° C. or lower, and even more preferably 200° C. or lower. If the flow beginning temperature ($T_A$) of the thermoplastic polyurethane (A) is 105° C. or higher, the thermoplastic polyurethane (A) is moderately hard. Therefore, the resultant golf ball does not deform, even if it is exposed to a high temperature, such as 80° C. or higher, by keeping the golf ball in a car. If the flow beginning temperature ($T_A$) of the thermoplastic polyurethane (A) is 210° C. or lower, the difference in viscosity between the thermoplastic polyurethane (A) and the urethane prepolymer (B) later described becomes less, and therefore the thermoplastic polyurethane (A) and the urethane prepolymer (B) can be mixed sufficiently.

The melt viscosity (210° C.) ($\eta_A$) of the thermoplastic polyurethane (A) is preferably 1,000 P or more, and more preferably 2,000 P or more, and even more preferably 3,000 P or more, and preferably 45,000 P or less, and more preferably 43,000 P or less, and even more preferably 40,000 P or less. If the melt viscosity (210° C.) ($\eta_A$) of the thermoplastic polyurethane (A) is 1,000 P or more, the number average molecular weight of the thermoplastic polyurethane (A) becomes essentially larger, and the abrasion resistance of the obtained golf ball improves even more. If the melt viscosity (210° C.) ($\eta_A$) of the thermoplastic polyurethane (A) is 45,000 P or less, the fluidity of the cover composition is favorable and desirable cover moldability is obtained, resulting in further improvement in durability of the obtained golf ball.

Next, the urethane prepolymer (B) having at least two isocyanate groups will be explained.

The urethane prepolymer (B) is not particularly limited as long as it is a compound having a plurality of urethane bonds and two or more isocyanate groups in a molecule thereof, and having lower molecular weight than that of the thermoplastic polyurethane (A). Such examples include an isocyanate group-terminated urethane prepolymer having urethane bonds formed in a molecule thereof by, for example, reacting a polyisocyanate and a polyol under a condition wherein the polyisocyanate is in excess. The blending ratio of the polyisocyanate component to the polyol component is preferably 1.1 or more, more preferably 1.3 or more, even more preferably 1.5 or more, and is preferably 3.0 or less, more preferably 2.5 or less, even more preferably 2.0 or less in a molar ratio (NCO/OH) of the isocyanate group (NCO) of the polyisocyanate component to the hydroxyl group (OH) of the polyol component.

The polyisocyanate component used as a raw material for the urethane prepolymer (B) is not limited, as long as the polyisocyanate has at least two isocyanate groups. Examples of the polyisocyanate component include polyisocyanates exemplified as the polyisocyanate component constituting the thermoplastic polyurethane (A). The polyol component used as a raw material for the urethane prepolymer (B) is not limited, as long as the polyol component has a plurality of hydroxyl groups. Examples of the polyol component include polyols such as a high-molecular weight polyol and a low-molecular weight polyol exemplified as the polyol component constituting the thermoplastic polyurethane (A).

The isocyanate group-terminated urethane prepolymer used as the urethane prepolymer (B) includes TDI based urethane prepolymer, MDI based urethane prepolymer, and $H_{12}$MDI based urethane prepolymer. Preferably used is MDI based urethane prepolymer or $H_{12}$MDI based urethane prepolymer. Herein, TDI based urethane prepolymer means an isocyanate group terminated urethane prepolymer obtained by reacting TDI or a polyisocyanate compound containing TDI as a main component with a polyol (preferably PTMG); MDI based urethane prepolymer means an isocyanate group terminated urethane prepolymer obtained by reacting MDI or a polyisocyanate compound containing MDI as a main component with a polyol (preferably PTMG), and $H_{12}$MDI based urethane prepolymer means an isocyanate group terminated urethane prepolymer obtained by reacting $H_{12}$MDI or a polyisocyanate compound containing $H_{12}$MDI with a polyol (preferably PTMG).

For a reaction between the polyisocyanate component and the polyol component, a catalyst which is publicly known for being used in the urethane reaction can be used. Examples of the catalyst include a monoamine such as triethylamine and N,N-dimethylcyclohexylamine; a polyamine such as N,N,N',N'-tetramethylethylenediamine and N,N,N',N'',N''-pentamethyldiethylenetriamine; a cyclic diamine such as 1,8-diazabicyclo[5,4,0]-7-undecene (DBU) and triethylenediamine; a tin catalyst such as dibutyltin dilaurylate and dibutyltin diacetate; an organic carboxylic acid such as azelaic acid, oleic acid and adipic acid.

The urethane prepolymer (B) preferably has NCO content (NCO %) of 0.5 mass % or more, more preferably 1.0 mass % or more, even more preferably 2.0 mass % or more, and preferably has NCO content (NCO %) of 10.0 mass % or less, more preferably 7.0 mass % or less, even more preferably 5.0 mass % or less. If the urethane prepolymer (B) has too low NCO content, the effect of the crosslinking may be little and the abrasion-resistance may also become worse, while if the urethane prepolymer has too high NCO content, the viscosity of the cover composition may increase to excess, resulting in lowering the moldability. NCO content (NCO %) of the urethane prepolymer (B) is defined as 100×[number of moles of the isocyanate group in the urethane prepolymer (B)×42 (molecular weight of NCO)]/[total amount (g) of the urethane prepolymer (B)]

A number average molecular weight of the urethane prepolymer (B) is preferably, for example, 1,000 or more, more preferably 1,500 or more, even more preferably 2,000 or more, and is preferably less than 20,000, more preferably 15,000 or less, even more preferably 10,000 or less. If the number average molecular weight is 1,000 or more, a distance between crosslinking points at a time of crosslinking reaction becomes longer, so that the resultant polyurethane cover does not become too hard, thereby improving durability thereof. On the other hand, if the number average molecular weight is 20,000 or more, the crosslinking density becomes low, so that abrasion-resistance of the resultant cover may be lowered.

The polyisocyanate component and the polyol component constituting the urethane prepolymer may be suitably selected from the components described above as the components constituting the thermoplastic polyurethane (A).

The number average molecular weight of the polyol component constituting the urethane prepolymer (B) is preferably 650 or more, more preferably 700 or more, even more preferably 800 or more, and is preferably 10,000 or less, more preferably 5,000 or less, even more preferably 3,000 or less. If the number average molecular weight is 650 or more, a distance between crosslinking points at a time of the crosslinking reaction becomes longer, so that the resultant polyurethane cover does not become too hard, and the durability thereof is improved. On the other hand, if the number average molecular weight is more than 10,000, the crosslinking density becomes low, so that the abrasion-resistance of the resultant cover may be lowered. The number average molecular weight of the urethane prepolymer (B) or the polyol component can be measured by Gel permeation Chromatography using two columns of TSK-GEL SUPREH 2500 (TOSOH Corporation) as a column, polystyrene as a standard material, and tetrahydrofuran as an eluate.

The functional number of the isocyanate group of the urethane prepolymer (B) used in the present invention is not particularly limited as long as it is at least two, and may be, for example, trifunctional or tetrafunctional. A polyfunctional urethane prepolymer which is at least trifunctional can be obtained by using an at least trifunctional polyol or polyisocyanate as the ones constituting the urethane prepolymer.

Examples of the trifunctional or more than trifunctional polyisocyanate include a trifunctional isocyanate such as polymeric MDI, triphenyl methane triisocyanate, tris(isocyanate phenyl)thiophosphate, lysin ester triisocyanate, 1,6,11-undecane triisocyanate, 1,8-diisocyanate-4-isocyanate methyloctane, 1,3,6-hexamethylene triisocyanate, and bicycloheptane triisocyanate; isocyanurate of diisocyanate; an adduct obtained by reacting diisocyanate with a triol having a low-molecular weight such as trimethylol propane or glycerin (free diisocyanate is preferably removed from the adduct); an allophanate modified polyisocyanate; a biuret modified polyisocyanate, and the like. The allophanate modified polyisocyanate is, for example, a trifunctional polyisocyanate obtained by reacting diisocyanate with a diol having a low-molecular weight to form a urethane bond and further reacting the urethane bond with the diisocyanate, and the biuret modified polyisocyanate is, for example, a trifunctional polyisocyanate obtained by reacting a diisocyanate with a diamine having a low-molecular weight to form a urea bond and further reacting the urea bond with the diisocyanate.

Among them, in the present invention, it is a preferred embodiment to use a bifunctional isocyanate group-terminated urethane prepolymer represented by the formula (1).

Polyisocyanate-(polyol-polyisocyanate)n (1)

In the formula (1), a connecting number n is preferably 1 or more and 10 or less, more preferably 5 or less, even more preferably 4 or less, further preferably 3 or less. If the connecting number n is 1 or more, a distance between the crosslinking points at the time of the crosslinking reaction becomes longer, so that the resultant polyurethane cover does not become too hard, and the durability thereof is improved. On the other hand, if the connecting number n is more than 10, the crosslink density becomes low, so that the abrasion-resistance of the resultant cover may be lowered.

With respect to a blending ratio of the thermoplastic polyurethane (A) and the urethane prepolymer (B) when preparing the cover composition, the amount of the urethane prepolymer (B) is preferably 1 part by mass or more, and more preferably 3 parts by mass or more, and even more preferably 5 parts by mass or more, and preferably 50 parts by mass or less, and more preferably 45 parts by mass or less, and even more preferably 40 parts by mass or less, with respect to 100 parts by mass of the thermoplastic polyurethane (A). If the blending ratio of the urethane prepolymer (B) is less than 1 part by mass with respect to 100 parts by mass of the thermoplastic polyurethane (A), the crosslinking effect of the urethane prepolymer (B) becomes small, and the effect of improving the abrasion resistance tends to be small. If the blending ratio of the urethane prepolymer (B) is more than 50 parts by mass with respect to 100 parts by mass of the thermoplastic polyurethane (A), the viscosity of the cover composition increases excessively, and moldability of the cover composition may deteriorate.

The thermoplastic polyurethane (A) and the urethane prepolymer (B) may be blended separately each as one component of the cover composition, however, it is also preferable to first melt-mix the thermoplastic polyurethane (A) and the urethane prepolymer (B) to make a reaction mixture (A+B), and then use this reaction mixture (A+B) to obtain a final cover composition.

With respect to a blending ratio of the thermoplastic polyurethane (A) and the urethane prepolymer (B) when preparing the reaction mixture (A+B), the amount of the urethane prepolymer (B) is preferably 1 part by mass or more, and more preferably 3 parts by mass or more, and even more preferably 5 parts by mass or more, and preferably 50 parts by mass or less, and more preferably 45 parts by mass or less, and even more preferably 40 parts by mass or less, with respect to 100 parts by mass of the thermoplastic polyurethane (A). If the blending ratio of the urethane prepolymer (B) is less than 1 part by mass with respect to 100 parts by mass of the thermoplastic polyurethane (A), the crosslinking effect of the urethane prepolymer (B) becomes small, and the effect of improving the abrasion resistance tends to be small. If the blending ratio of the urethane prepolymer (B) is more than 50 parts by mass with respect to 100 parts by mass of the thermoplastic polyurethane (A), the viscosity of the cover composition increases excessively, and moldability of the cover composition may deteriorate. A method for melt-mixing the thermoplastic polyurethane (A) and the urethane prepolymer (B) is described later.

The temperature difference ($T_{A+B}-T_A$) between the flow beginning temperature ($T_{A+B}$) of the reaction mixture (A+B) and the flow beginning temperature ($T_A$) of the thermoplastic polyurethane (A) is preferably −5° C. or larger, and more preferably 0° C. or larger, and even more preferably 2° C. or larger, and preferably 40° C. or smaller, and more preferably 35° C. or smaller, and even more preferably 30° C. or smaller. If the temperature difference ($T_{A+B}-T_A$) of the flow beginning temperatures is larger than 40° C., the fluidity of the cover composition reduces and moldability of the cover composition tends to deteriorate. If the temperature difference ($T_{A+B}-T_A$) of the flow beginning temperatures is smaller than −5° C., the crosslinking effect of the urethane prepolymer (B) becomes small, and the effect of improving the abrasion resistance may reduce.

The ratio ($\eta_{A+B}/\eta_A$) of the melt viscosity ($\eta_{A+B}$) of the reaction mixture (A+B) to the melt viscosity ($\eta_A$) of the thermoplastic polyurethane (A) is preferably 0.7 or more, and more preferably 1.0 or more, and even more preferably 1.5 or more, and preferably 12.0 or less, and more preferably 8.0 or less, and even more preferably 6.0 or less. If the ratio ($\eta_{A+B}/\eta_A$) of the melt viscosities is more than 12.0, the fluidity of the cover composition reduces and the moldability of the cover composition tends to deteriorate. If the ratio ($\eta_{A+B}/\eta_A$) of the melt viscosities is less than 0.7, the crosslinking effect of the urethane prepolymer (B) becomes small, and the effect of improving abrasion resistance may not be achieved.

The cover composition may further include other resin components as a resin component, in addition to the thermoplastic polyurethane (A) and the urethane prepolymer (B) to the extent that the effects of the present invention do not deteriorate. The other resins include, for example, an ionomer resin and a thermoplastic elastomer. Examples of the ionomer resin include one prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms, and α,β-unsaturated carboxylic acid ester with a metal ion, or a mixture thereof. The specific examples of the ionomer resin include Himilan available from MITSUI-DUPONT POLYCHEMICAL, Surlyn available from DUPONT CO., and Iotek available from ExxonMobil Corp. The specific examples of the thermoplastic elastomer include a thermoplastic polyamide elastomer having a commercial name of "PEBAX", for example, "PEBAX 2533" available from ARKEMA Inc, a thermoplastic polyester elastomer having a commercial name of "HYTREL", for example, "HYTREL 3548", and "HYTREL 4047" available from DU PONT-TORAY Co., and a thermoplastic polystyrene elastomer having a commercial name of "Rabalon" available from Mitsubishi Chemical Co.

When using the other resin component as a resin component contained in the cover composition, a required percentage of the combined amount of the thermoplastic polyurethane (A) and the urethane prepolymer (B) having two or more isocyanate groups, among the total amount of resin components is 50 mass % or higher, and preferably 60 mass % or higher, and more preferably 70 mass % or higher. In a preferable embodiment, the resin component constituting the cover composition does not contain a thermoplastic resin (e.g. ionomer resin, thermoplastic polystyrene elastomer) which substantially does not react with an isocyanate group, and in a more preferable embodiment, the resin component constituting the cover composition consists of the thermoplastic polyurethane (A) and the urethane prepolymer (B).

The cover composition in the present invention may contain, other than the above-mentioned resin component, a pigment component such as titanium oxide and a blue pigment, a gravity adjusting agent such as calcium carbonate and barium sulfate, a dispersant, an antioxidant, an ultraviolet absorber, a light stabilizer, a fluorescent material or a fluorescent brightener to the extent that the cover performance is not damaged.

The content of the white pigment (titanium oxide) is preferably 0.5 part by mass or more, more preferably 1 part by mass or more, and preferably 10 parts by mass or less, more preferably 8 parts by mass or less based on 100 parts by mass of the resin component constituting the cover. The white pigment in an amount of 0.5 part by mass or more can impart opacity to the cover, while the white pigment in an amount of more than 10 parts by mass may lower the durability of the resulting cover.

The cover composition of the present invention has a slab hardness of 20 or more, more preferably 25 or more, even more preferably 30 or more, and has a slab hardness of 60 or less, more preferably 55 or less, even more preferably 50 or less in Shore D hardness. If the slab hardness of the cover composition is 20 or more in Shore D hardness, the golf ball having an excellent spin performance is obtained, while if the slab hardness of the cover composition is 60 or less in Shore D hardness, the shot feeling when hitting the golf ball is improved.

In a method for manufacturing the golf ball of the present invention, first, the thermoplastic polyurethane (A), the urethane prepolymer (B), and if necessary, an additive for a cover, such as titanium oxide and the like are blended to prepare the cover composition.

Examples of blending the cover composition include: an embodiment (I) in which a reaction mixture (A+B) is prepared first by melt-mixing a thermoplastic polyurethane (A) and a urethane prepolymer (B), and then the reaction mixture (A+B) and an additive for a cover, such as titanium oxide, are mixed; an embodiment (II) in which a thermoplastic polyurethane (A) and an additive for a cover, such as titanium oxide, are mixed to form a pellet, and then the pellet and a urethane prepolymer (B) are mixed; and an embodiment (III) in which a thermoplastic polyurethane (A), a urethane prepolymer (B), and an additive for a cover, such as titanium oxide, are mixed simultaneously. Among these modes, the embodiment (I) is preferred.

In the embodiment (I), the method for preparing the reaction mixture (A+B) by melt-mixing the thermoplastic polyurethane (A) and the urethane prepolymer (B) is not limited, but an extruder is preferably used. When melt-mixing is conducted using the extruder, a heating condition of the mixture that contains the thermoplastic polyurethane (A) and the urethane prepolymer (B) is preferably controlled. Specifically, temperatures of a cylinder and a die are preferably in a range from 150° C. to 230° C. inclusive, and a retention time within the cylinder is preferably in a range from 0.1 to 60 minutes inclusive. For example, in the case that the thermoplastic polyurethane (A) is placed first in the cylinder alone and then the urethane prepolymer (B) is added from a midway position of the cylinder by using a side feeder or the like, the heating temperature and the retention time may be controlled at a position downstream of the position where the urethane prepolymer (B) was added. Furthermore, screw parameters of the extruder are not limited, but, for example, screw parameters with a screw diameter of 20 mm to 150 mm inclusive, a screw rotational speed of 30 rμm to 200 rμm inclusive, and a screw L/D of 15 to 100 inclusive, may be employed.

The method for mixing the reaction mixture (A+B) and the additive for the cover, such as titanium oxide, is not limited, however, for example, a mixing machine capable of blending raw materials that are in pellet-form, is preferably used, and more preferably a tumbler mixer is used.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the present invention, the embodiment which comprises injection molding the cover composition directly onto the core is preferable. In the case that the cover composition is subjected to injection molding onto the core, the cover composition is prepared into a pellet form with an extruder and then the pellet is injection molded, or the cover materials may be mixed into the cover composition, which is directly injection molded without pelletization.

In the case that the cover composition is subjected to direct injection molding onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold. The crosslinking can be further proceeded by post-curing the golf ball having the molded cover at the temperature of 40° C. or more for 4 to 96 hours.

In the present invention, use of the thermoplastic polyurethane (A) and the urethane prepolymer (B) suppresses the crosslinking reaction when molding the cover, and promotes the crosslinking reaction after molding the cover, thereby improving the abrasion-resistance of the cover without scarifying the productivity of the golf ball. The crosslinking of the cover can be confirmed by the following method.

The thermoplastic polyurethane (A) crosslinked with the urethane prepolymer (B) is insoluble in the solvent in which the linear thermoplastic polyurethane (A) is soluble. The solvent in which the linear thermoplastic polyurethane (A) is soluble includes, for example, N,N-dimethylformamide (DMF), tetrahydrofuran (THF) or the like. Namely, the thermoplastic polyurethane without being crosslinked is readily soluble in the solvent, but the thermoplastic polyurethane crosslinked with the polyisocyanate mixture (B) is insoluble in the solvent. According to this difference, it is possible to confirm whether the thermoplastic polyurethane is crosslinked or not.

Further, the thermoplastic polyurethane (A) crosslinked with the urethane prepolymer (B) has an allophanate bond or a biuret bond formed. These bonds are weaker than the urethane bond or the urea bond which constitute the main molecular chain of the thermoplastic polyurethane. Accordingly, the allophanate bond or a biuret bond forming the crosslinking structure can be broken by a treatment with a DMF solution of n-butylamine or a heat treatment.

The DMF solution of n-butyl amine preferably has a concentration of 0.01 mol/l to 0.25 mol/l, more preferably 0.05 mole/l. The heat treatment is preferably conducted at the temperature of 130 to 150° C. for 2 to 4 hours.

In addition, it is possible to confirm what kind of the urethane prepolymer (B) crosslinks the thermoplastic polyurethane (A), by analyzing the product which is treated with the DMF solution of n-butyl amine or treated with heat, using gel permeation chromatography (GPC), Fourier transform infrared spectrophotometer (FT-IR), nuclear magnetic resonance apparatus (NMR) or the like.

When molding a cover, the concave portions called "dimple" are usually formed on the surface. After the cover is molded, the mold is opened and the golf ball body is taken out from the mold, and as necessary, the golf ball body is preferably subjected to surface treatment such as deburring, cleaning, and sandblast. If desired, a paint film or a mark may be formed. There are no limitations on the thickness of the paint film, but preferably 5 μm or larger, and more preferably 7 μm or larger, and preferably 25 μm or smaller, and more preferably 18 μm or smaller. This is because if the thickness is smaller than 5 μm, the paint film is easy to wear off due to continued use of the golf ball, and if the thickness is larger than 25 μm, the effect of dimples is reduced, resulting in deteriorating the flying performance of the golf ball.

In the present invention, the golf ball preferably has a cover thickness of 2.0 mm or smaller, more preferably 1.6 mm or smaller, even more preferably 1.0 mm or smaller. If the cover thickness is 2.0 mm or smaller, the repulsion of the golf ball is enhanced to give a long drive distance as a total. The lower limit of the cover thickness of the golf ball is preferably, without limitation, 0.1 mm. If the thickness of the cover is less than 0.1 mm, the molding of the cover becomes difficult.

Next, a preferred embodiment of the core of the golf ball of the present invention will be explained.

The core of the golf ball of the present invention includes a single-layered core, a core consisting of a center and a single-layered intermediate layer covering the core, a core consisting of a center and multi-piece intermediate layers covering the center, or a core consisting of a center and multi-layered intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs, preferably the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east (west), assuming that the meridian as the standard is at longitude 0 degrees. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

As the core or the center of the golf ball of the present invention, a conventionally known rubber composition (hereinafter simply referred to as "core rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.2 part by mass or more, more preferably 0.3 part by mass or more, and preferably 3 parts by mass or less, more preferably 2 parts by mass or less based on 100 parts by mass of the base rubber. If the amount is less than 0.2 part by mass, the core becomes too soft, and the resilience tends to be lowered, and if the amount is more than 3 parts by mass, the amount of the co-crosslinking agent needs to be increased in order to obtain an appropriate hardness, so that the resilience tends to be insufficient.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience. The amount of the co-crosslinking agent to be used is preferably 10 parts or more, more preferably 20 parts or more, and is preferably 50 parts or less, more preferably 40 parts or less based on 100 parts of the base rubber by mass. If the amount of the co-crosslinking agent to be used is less than 10 parts by mass, the amount of the organic peroxide must be increased to obtain an appropriate hardness which tends to lower the resilience. On the other hand, if the amount of the co-crosslinking agent to be used is more than 50 parts by mass, the core becomes too hard, so that the shot feeling may be lowered.

The filler contained in the rubber composition for the core is mainly blended as a gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 2 parts or more, more preferably 3 parts or more, and preferably 50 parts or less, more preferably 35 parts or less based on 100 parts of the base rubber by mass. If the amount of the filler to be blended is less than 2 parts by mass, it becomes difficult to adjust the weight, while if it is more than 50 parts by mass, the weight ratio of the rubber component becomes small and the resilience tends to be lowered.

As the core rubber composition, an organic sulfur compound, an antioxidant or a peptizing agent may be blended as appropriate in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis(2-cyano-4-chloro-6-bromophenyl)disulfide; a tetra-substituted diphenyl disulfide such as bis(2,3,5,6-tetra chlorophenyl)disulfide; a penta-substituted diphenyl disulfide such as bis(2,3,4,5,6-pentachlorophenyl)disulfide and bis(2,3,4,5,6-pentabromophenyl)disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the peptizing agent is preferably 0.1 part or more and is preferably 5 parts or less based on 100 parts of the base rubber by mass.

The conditions for press-molding the rubber composition should be determined depending on the rubber composition. The press-molding is preferably carried out for 10 to 60 minutes at the temperature of 130 to 200° C. Alternatively, the press-molding is preferably carried out in a two-step heating, for example, for 20 to 40 minutes at the temperature of 130 to 150° C., and continuously for 5 to 15 minutes at the temperature of 160 to 180° C. When forming a core having a difference in the hardness between the surface hardness and the center hardness, it is preferable to heat for 10 to 60 minutes at the temperature of 130 to 200° C.

The diameter of the core of the golf ball of the present invention is preferably 39.0 mm or more, more preferably 39.5 mm or more, even more preferably 40.8 mm or more. If the diameter of the core is less than 39.0 mm, the thickness of the cover becomes too thick, so that the resilience is lowered. The diameter of the core is preferably, but not limited to, 42.2 mm or less, more preferably 42.0 mm or less, even more preferably 41.8 mm or less. If the diameter of the core is more than 42.2 mm, the cover becomes relatively too thin, so that the protection effects of the cover cannot be sufficiently obtained.

The core preferably has a compression deformation amount (deformation amount along the shrinkage direction) of 2.50 mm or more, and more preferably 2.60 mm or more, even more preferably 2.70 mm or more, and preferably has a compression deformation amount of 3.20 mm or less, more preferably 3.10 mm or less, even more preferably 3.00 mm or less, when applying a load from 98 N as an initial load to 1275 N as a final load. If the above compression deformation amount is less than 2.50 mm, the core becomes too hard, so that the shot feeling tends to be lowered. If the above compression deformation amount is larger than 3.20 mm, the core becomes too soft, so that the shot feeling tends to be heavy.

In a preferable embodiment, the core having a surface hardness larger than the center hardness is used. Making the core have a multi-layered structure easily provides the core with a surface hardness larger than the center hardness. The difference between the surface hardness and the center hardness of the core used for the golf ball the present invention is preferably 4 or more, more preferably 8 or more in Shore D hardness. By making the core have the surface hardness larger than the center hardness, a launch angle is increased and an amount of spin is lowered, so that flying distance is improved. The upper limit of the difference between the surface hardness and the center hardness of the core is not limited, but preferably 24, more preferably 20 in Shore D hardness. If the difference of the hardness is too large, the durability tends to be lowered.

The center hardness of the core is preferably 30 or more, more preferably 32 or more, even more preferably 35 or more in Shore D hardness. If the center hardness of the core is less than 30 in Shore D hardness, the golf ball tends to become so soft that the resilience will be lowered. On the other hand, the center hardness of the core is preferably 50 or less, more preferably 48 or less, even more preferably 45 or less in shore D hardness. If the center hardness is more than 50 in Shore D hardness, the golf ball becomes so hard that the shot feeling may be lowered. In the present invention, the center hardness of the core means the hardness obtained by measuring the central point of the cut surface of the core cut into halves with the Shore D type spring hardness tester.

The surface hardness of the core is preferably 45 or more, more preferably 50 or more, even more preferably 55 or more in Shore D hardness. If the surface hardness is less than 45 in Shore D hardness, the golf ball may become too soft, resulting in lowering of resilience. On the other hand, the surface hardness of the core is preferably 65 or less, more preferably 62 or less, even more preferably 60 or less in Shore D hardness. If the surface hardness is larger than 65 in Shore D hardness, the golf ball may become too hard, resulting in lowering of the shot feeling.

The core of the golf ball of the present invention preferably has a PGA compression of 65 or more, more preferably 70 or more. If the core has the PGA compression of less than 65, the core becomes so soft that the shot feeling becomes too heavy. The core of the golf ball of the present invention preferably has a PGA compression of 115 or less, more preferably 110 or less. If the core has the PGA compression of more than 115, the core becomes too hard so that the shot feeling deteriorates.

In the case that the core consists of a center and a single layered intermediate layer covering the center, that the core consists of a center and multi-layered intermediate layers covering the center, or that the core consists of a center and multi-piece intermediate layers covering the center, the materials constituting the intermediate layer includes, for example, a thermoplastic resin such as a polyurethane resin, an ionomer resin, nylon and polyethylene, and a thermoplastic elastomer such as a polystyrene elastomer, a polyolefin elastomer, a polyurethane elastomer, a polyester elastomer. The ionomer resin is preferable.

Examples of the ionomer resin include an ionomer resin prepared by neutralizing at least a part of carboxyl groups in a copolymer composed of ethylene and α,β-unsaturated carboxylic acid having 3 to 8 carbon atoms with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Examples of the α,β-unsaturated carboxylic acids are; acrylic acid, methacrylic acid, fumaric acid, maleic acid and crotonic acid. Among these, acrylic acid and methacrylic acid are particularly preferred. Examples of the α,β-unsaturated carboxylic acid ester include methyl ester, ethyl ester, propyl ester, n-butyl ester, isobutyl ester of acrylic acid, methacrylic acid, fumaric acid, and maleic acid. In particular, acrylic acid ester and methacrylic acid ester are preferable. Examples of the metal ion for neutralizing at least a part of the carboxyl groups in the copolymer composed of ethylene and the α,β-unsaturated carboxylic acid or in the terpolymer composed of ethylene, the α,β-unsaturated carboxylic acid, and the α,β-unsaturated carboxylic acid ester are; alkali metal ions such as sodium, potassium, and lithium; divalent metal ions such as magnesium, calcium, zinc, barium, and cadmium; trivalent metal ions such as aluminum, or other metal ions such as tin and zirconium. In particular, sodium ion, zinc ion, and magnesium ion are preferably used in view of the resilience and durability of the golf ball.

The intermediate layer of the golf ball of the present invention may contain a specific gravity adjustment agent such as barium sulfate and tungsten, an antioxidant, and a pigment in addition to the above resin component.

The golf ball of the present invention is not particularly limited on a structure thereof as long as the golf ball has a core and a cover. Examples of the golf ball of the present invention include a two-piece golf ball comprising a single-layered core, and a cover covering the core; a three-piece golf ball comprising a core consisting of a center and an intermediate layer covering the center, and a cover covering the core; a multi-piece golf ball comprising a core consisting of a center and a multi-piece or multi-layer of intermediate layers covering the center, and a cover covering the core; and a wound golf ball comprising a wound core, and a cover covering the wound core. The present invention can be suitably applied to anyone of the above golf ball. Among them, the present invention can be preferably applied to the two-piece golf ball including a single-layered core, and a cover covering the core.

When preparing a wound golf ball in the present invention, a wound core may be used as the core. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of a natural rubber and a synthetic polyisoprene, a sulfur, a vulcanization auxiliary agent, a vulcanization accelerator, and an antioxidant. The rubber thread is wound around the center in elongation of about 10 times length to form the wound core.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Flow Beginning Temperature

The flow beginning temperature of a pellet-form sample was measured with the following conditions by using a flow characteristics evaluation apparatus (Flow Tester CFT-500D, manufactured by Shimadzu Corporation).

Measuring Conditions

Area size of a plunger: 1 $cm^2$

Die length: 1 mm

Die diameter: 1 mm

Load: 588.399 N

Start temperature: 30° C.

Temperature increase rate: 3° C./min.

(2) Melt Viscosity

The melt viscosity of a pellet-form sample was measured with the following conditions by using a flow characteristics evaluation apparatus (Flow Tester CFT-500D, manufactured by Shimadzu Corporation).

Measuring Conditions

Die length: 1 mm

Die diameter: 1 mm

Load: 294 N

Temperature: 190° C., 210° C.

(3) Hardness of a Spherical Shape Core

An auto loading durometer (type P1, manufactured by Kobunshi Keiki Co., Ltd.) that comprises a Shore D type spring hardness tester which complies to ASTM-D2240 standard was used to measure a surface hardness and the center hardness of a spherical shape core. A Shore D hardness measured at a surface of the spherical shape core was regarded as the surface hardness of the spherical shape core. The spherical shape core was cut into two hemispheres to obtain a cut plane, and a Shore D hardness measured at the center of the cut plane was used as the center hardness of the spherical shape core.

(4) Slab Hardness (Shore D Hardness)

Sheets with a thickness of approximately 2 mm were manufactured using the cover composition by hot press molding, and stored for 2 weeks at 23° C. Three or more of these sheets were stacked on one another so as not to be affected by the measuring base on which the sheets were placed, and the stack was measured with a auto loading durometer (type P1, manufactured by Kobunshi Keiki Co., Ltd.) that comprises a Shore D type spring hardness tester which complies to ASTM-D2240 standard.

(5) Abrasion Resistance

A commercially available pitching wedge was installed on a swing robot M/C manufactured by Golf Laboratories, Inc., and two points of a ball were both hit once at a head speed of 36 m/sec. Each impact point was evaluated and ranked into four criteria.

Evaluation Criteria

E (Excellent): Almost no scratches are on the surface of the golf ball.

G (Good): A slight scratch is formed on the surface of the golf ball.

F (Fair): The surface of the golf ball is slightly abraded, and scuffing is generated.

P (Poor): The surface of the golf ball is considerably abraded, and scuffing is prominent.

(6) Durability

A metal-headed #W1 driver was installed on a swing robot M/C manufactured by Golf Laboratories, Inc., and each golf ball was hit at a head speed of 45 m/sec. This procedure was repeated, and the number of hits required to break the golf ball was counted. The number of hits required to break golf ball No. 1 was defined as an index of 100, and the durability of each golf ball was represented by converting the number of hits required to break each golf ball into this index. A large value of the index means superior durability of the golf ball.

(7) Spin Performance

An approach wedge (SRIXON I-302, manufactured by SRI Sports Limited) was installed on a swing robot M/C manufactured by Golf Laboratories, Inc. A golf ball was hit at a head speed of 21 m/sec, and a sequence of photographs of the hit golf ball was taken to measure the spin speed (rpm). The measurement was performed ten times for each golf ball, and each average value was regarded as the spin speed. The spin speed of golf ball No. 1 was defined as an index of 100, and spin speed of each golf ball was represented by converting the spin speed of each golf ball into this index.

[Preparation for a Reaction Mixture (A+B)]

An isocyanate group terminated urethane prepolymer (B) was obtained by reacting given amounts of a polyisocyanate and a polyol shown in Table 1 under a blanket of dry nitrogen gas at 80° C. for two hours.

Next, a pellet of a reaction mixture (A+B) was obtained by mixing a thermoplastic polyurethane (A) (Elastollan XNY85A10, manufactured by BASF Co., Ltd.) and the isocyanate group terminated urethane prepolymer (B) at a mass ratio shown in Table 1 by using a single-screw extruder (2D25S, manufactured by Toyo Seiki Seisaku-sho Ltd.). Specifically, the thermoplastic polyurethane (A) was first placed in a cylinder, and melted. Next the urethane prepolymer (B) was added to the cylinder by using a side feeder. The temperature of the cylinder at each positions was set as follows: 200° C. at a front portion, 190° C. at a mid portion, and 180° C. at a rear portion, and the temperature at a die position was set at 190° C. A retention time of the mixture was set to be 2 minutes at a position downstream of the position where the urethane prepolymer (B) was added. Furthermore, a screw diameter of 20 mm, a screw rotational speed of 70 rμm, and screw L/D=25 were used as screw parameters.

[Preparation of Mixture I]

A pellet of mixture I was obtained, by mixing 100 parts by mass of a thermoplastic polyurethane (A) (Elastollan XNY85A10, manufactured by BASF Co., Ltd.) and 10 parts by mass of an isocyanate mixture (Crossnate EM-30, manufactured by Dainichiseika Color & Chemicals Mfg. Co., Ltd.) by using a single-screw extruder (2D25S, manufactured by Toyo Seiki Seisaku-sho Ltd.). The mixture was heated to a temperature in a range from 150° C. to 230° C. at a die position of the extruder.

[Preparation of Mixture J]

An isocyanate group terminated urethane prepolymer was obtained by reacting given amounts of 4,4'-diphenylmethane diisocyanate and poly(tetramethylene glycol) (number average molecular weight: 1,000) under a blanket of dry nitrogen gas at 80° C. for two hours. Next, a thermoplastic polyester elastomer (Hytrel (registered trademark) 3046, manufactured by Du Pont-Toray Co., Ltd.), which was dried in advance in order to remove moisture, was prepared as a thermoplastic resin that essentially does not react with an isocyanate group. 35 parts by mass of the obtained isocyanate group terminated urethane prepolymer and 65 parts by mass of the thermoplastic polyester elastomer were kneaded in a mixing roll at a temperature in a range from 120° C. to 180° C. for 5 to 10 minutes. The obtained kneaded object was taken out from the mixing roll, and pulverized in order to obtain a master batch of a urethane prepolymer.

A pellet of mixture J was obtained, by mixing 100 parts by mass of a thermoplastic polyurethane (A) (Elastollan XNY85A10, manufactured by BASF Co., Ltd.) and 15 parts by mass of the obtained master batch by using a single-screw extruder (2D25S, manufactured by Toyo Seiki Seisaku-sho Ltd.). The mixture was heated to a temperature in a range from 150° C. to 230° C. at a die position of the extruder.

TABLE 1

| | | | TPU | Reaction Mixture (A + B) | | | | | | |
|---|---|---|---|---|---|---|---|---|---|---|
| | | | A | B | C | D | E | F | G | H |
| Formulation | Thermoplastic Polyurethane (A) | XNY85A10 | 100 | 100 | 100 | 100 | 100 | 100 | 100 | 100 |
| | Urethane Prepolymer (B) | | — | 5 | 10 | 15 | 20 | 10 | 10 | 10 |
| | Formulation (mole ratio) Isocyanate | MDI | — | 2 | 2 | 2 | 2 | 2 | 2 | 2 |
| | Formulation (mole ratio) Polyol | PTMG (Mn1000) | — | 1 | 1 | 1 | 1 | — | — | — |
| | | PTMG (Mn5000) | — | — | — | — | — | 1 | — | — |
| | | PTMG (Mn3000) | — | — | — | — | — | — | 1 | — |
| | | PTMG (Mn300) | — | — | — | — | — | — | — | 1 |
| | Number Average Molecular Weight | | — | 1500 | 1500 | 1500 | 1500 | 5500 | 3500 | 800 |
| | NCO content (mass %) | | — | 5.6 | 5.6 | 5.6 | 5.6 | 1.5 | 2.4 | 10.5 |
| | Isocyanate Mixture | Crossnate EM-30 | — | — | — | — | — | — | — | — |
| | Master Batch of Urethane Prepolymer | | — | — | — | — | — | — | — | — |
| Properties | Flow beginning temperature [° C.] | | 124 | 126 | 130 | 141 | 158 | 122 | 127 | 142 |
| | Temperature Difference from Flow beginning temperature of Thermoplastic Polyurethane (A) [° C.] | | — | 2 | 6 | 17 | 34 | −2 | 3 | 18 |
| | Melt Viscosity (190° C.) [P] | | 36600 | 48600 | 160000 | 198000 | 280600 | 34200 | 82000 | 291300 |
| | Melt Viscosity (210° C.) [P] | | 4800 | 6300 | 23200 | 36800 | 51300 | 4700 | 13700 | 39500 |
| | Ratio (Mixture/A), to Melt Viscosity of Thermoplastic Polyurethane (A) | | — | 1.31 | 4.83 | 7.67 | 10.69 | 0.98 | 2.85 | 8.23 |

| | | | Mixture | |
|---|---|---|---|---|
| | | | I | J |
| Formulation | Thermoplastic Polyurethane (A) | XNY85A10 | 100 | 100 |
| | Urethane Prepolymer (B) | | — | — |
| | Formulation (mole ratio) Isocyanate | MDI | — | — |
| | Formulation (mole ratio) Polyol | PTMG (Mn1000) | — | — |
| | | PTMG (Mn5000) | — | — |
| | | PTMG (Mn3000) | — | — |
| | | PTMG (Mn300) | — | — |
| | Number Average Molecular Weight | | — | — |
| | NCO content (mass %) | | — | — |
| | Isocyanate Mixture | Crossnate EM-30 | 10 | — |
| | Master Batch of Urethane Prepolymer | | — | 15 |
| Properties | Flow beginning temperature [° C.] | | 180 or more | 125 |
| | Temperature Difference from Flow beginning temperature of Thermoplastic Polyurethane (A) [° C.] | | 56 or more | 1 |
| | Melt Viscosity (190° C.) [P] | | 1210000 | 47200 |
| | Melt Viscosity (210° C.) [P] | | 184500 | 6200 |
| | Ratio (Mixture/A) (to Melt Viscosity of Thermoplastic Polyurethane (A)) | | 38.4 | 1.29 |

Formulation: parts by mass
Notes on table 1;
XNY85A10: Thermoplastic polyurethane (slab hardness (Shore D): 32, number average molecular weight: 65,000), manufactured by BASF Co., Ltd.
MDI: 4,4'-diphenylmethane diisocyanate
PTMG: polytetramethylene ether glycol
Crossnate EM-30: A product, in which MDI is dispersed in thermoplastic polyester resin (MDI content: 30 mass %), Manufactured by Dainichiseika Color & Chemicals Mfg. Co., Ltd.

[Manufacturing a Two Piece Golf Ball]

(1) Manufacturing a Core

A spherical shape core with a diameter of 40.7 mm was obtained, by kneading a formulation of a core rubber composition shown in Table 2, and heat pressing the kneaded object in upper and lower molds, each having a hemispherical cavity, at a temperature of 160° C. for 13 minutes.

TABLE 2

| Core Rubber Composition | | |
|---|---|---|
| Formulation | Polybutadiene Rubber | 100 |
| | Zinc Acrylate | 35 |
| | Zinc Oxide | 5.0 |
| | Barium Sulfate | 14.0 |

TABLE 2-continued

| Core Rubber Composition | | |
|---|---|---|
| | Diphenyl Disulfide | 0.5 |
| | Dicumyl Peroxide | 0.9 |
| Properties | Center Hardness of Core (Shore D Hardness) | 40 |
| | Surface Hardness of Core (Shore D Hardness) | 58 |

Formulation: parts by mass
Notes on table 2
Polybutadiene Rubber: "BR730 (high-cis polybutadiene)", manufactured by JSR Co., Ltd.
Zinc Acrylate: "ZNDA-90S", manufactured by Nihon Jyoryu Co., Ltd.
Zinc Oxide: "Ginrei R", manufactured by Toho-zinc Co., Ltd.
Barium Sulfate: "Barium Sulfate BD", manufactured by Sakai Chemical Industry Co., Ltd
Diphenyl Disulfide: Manufactured by Sumitomo Seika Chemicals Co., Ltd.
Dicumyl Peroxide: "Percumyl (registered trademark) D", manufactured by NOF Corporation.

(2) Preparation of a Cover Composition and Manufacturing a Golf Ball Body

By using a tumbler mixer, a cover composition was prepared by dry blending a reaction mixture (A+B) or a mixture, and an additive for a cover (titanium oxide), all of which are shown in Table 3.

A cover is molded by direct injection-molding the obtained cover composition onto the core. Upper and lower molds for forming the cover each have a spherical cavity with pimples, and some of the pimples serve as hold pins which are extendable and retractable. The hold pins were protruded to hold the core, resin heated to a temperature of 210° C. was loaded into the mold under a pressure of 80 ton for 0.3 seconds, and cooled for 30 seconds. Then, the mold was opened, and the golf ball body was taken out therefrom.

(3) The surface of the obtained golf ball was treated with sandblast, marked, painted with a clear paint, and after the paint was dried at 40° C. for 4 hours in an oven, a golf ball with a diameter of 42.7 mm and a mass of 45.4 g was obtained.

Evaluation results of abrasion resistance, durability, and spin performance for the obtained golf ball are also shown in Table 3.

TABLE 3

| | | | | Golf Ball No. | | | | | | | | | |
|---|---|---|---|---|---|---|---|---|---|---|---|---|---|
| | | | | 1 | 2 | 3 | 4 | 5 | 6 | 7 | 8 | 9 | 10 |
| Cover Composition | Formulation | Mixture | A | 100 | — | — | — | — | — | — | — | — | — |
| | | | B | — | 100 | — | — | — | — | — | — | — | — |
| | | | C | — | — | 100 | — | — | — | — | — | — | — |
| | | | D | — | — | — | 100 | — | — | — | — | — | — |
| | | | E | — | — | — | — | 100 | — | — | — | — | — |
| | | | F | — | — | — | — | — | 100 | — | — | — | — |
| | | | G | — | — | — | — | — | — | 100 | — | — | — |
| | | | H | — | — | — | — | — | — | — | 100 | — | — |
| | | | I | — | — | — | — | — | — | — | — | 100 | — |
| | | | J | — | — | — | — | — | — | — | — | — | 100 |
| | | Titanium Oxide | | 4 | 4 | 4 | 4 | 4 | 4 | 4 | 4 | 4 | 4 |
| | Properties | Slab Hardness (Shore D) | | 32 | 32 | 31 | 31 | 31 | 30 | 31 | 36 | 38 | 31 |
| Golf Ball Properties | | Cover Thickness (mm) | | 1.0 | 1.0 | 1.0 | 1.0 | 1.0 | 1.0 | 1.0 | 1.0 | 1.0 | 1.0 |
| | | Abrasion resistance | | G | G | E | E | E | F | G | G | G | F |
| | | Spin Performance | | 100 | 105 | 121 | 126 | 131 | 105 | 115 | 92 | 88 | 99 |
| | | Durability | | 100 | 103 | 111 | 121 | 126 | 107 | 109 | 85 | 72 | 91 |

Formulation: parts by mass

The obtained golf balls No. 2 to No. 8 are golf balls having a cover formed from the cover composition that contains a thermoplastic polyurethane (A) and a urethane prepolymer (B) as resin components. Among these golf balls, it is obvious that golf balls No. 2 to No. 5, and No. 7 have improved abrasion resistance, durability, and spin performance, when compared to golf ball No. 1 in which thermoplastic polyurethane (A) is only used as the resin component. Golf ball No. 6 has a slightly inferior abrasion resistance, because the number average molecular weight of a polyol component constituting the urethane prepolymer (B) is large and the amount of isocyanate group in the urethane prepolymer (B) is small. Golf ball No. 8 has a slightly inferior spin performance and durability, because the number average molecular weight of a polyol component constituting the urethane prepolymer (B) is small and the amount of isocyanate group in the urethane prepolymer (B) is large.

Golf ball No. 9 has a cover formed from a cover composition that contains, as resin components, a thermoplastic polyurethane (A) and an isocyanate mixture that has an isocyanate compound dispersed into a thermoplastic resin which substantially does not react with an isocyanate group. It is obvious that this golf ball No. 9 has significantly inferior spin performance and durability when compared to golf ball No. 1. Golf ball No. 10 has a cover formed from a cover composition that contains, as resin components, a master batch containing a urethane prepolymer (B) and a thermoplastic resin that essentially does not react with an isocyanate group, and a thermoplastic polyurethane (A). It is obvious that this golf ball No. 10 has inferior abrasion resistance, spin performance, and durability when compared to golf ball No. 1.

The present invention is suitable for a golf ball having superior abrasion resistance, durability, and spin performance. This application is based on Japanese Patent application No. 2008-109169 filed on Apr. 18, 2008, the contents of which are hereby incorporated by reference.

What is claimed is:

1. A golf ball comprising a core and a cover, wherein the cover is formed from a cover composition that contains, as a resin component, only a reaction mixture (A+B) obtained by melt-mixing a thermoplastic polyurethane (A) and a urethane prepolymer (B) having two or more isocyanate groups; and wherein the urethane prepolymer (B) has a NCO content from 2.0 mass % to 7.0 mass %.

2. The golf ball according to claim 1, wherein the reaction mixture (A+B) is obtained by mixing the urethane prepolymer (B) in an amount of from 1 part to 50 parts by mass with respect to 100 parts by mass of the thermoplastic polyurethane (A).

3. The golf ball according to claim 1, wherein the temperature difference ($T_{A+B}-T_A$) between the flow beginning temperature ($T_A+_B$) of the reaction mixture (A+B) and the flow beginning temperature ($T_A$) of the thermoplastic polyurethane (A) is in a range from −5° C. to 40° C.

4. The golf ball according to claim 1, wherein the ratio ($\eta A+B/\eta A$) of the melt viscosity ($\eta A+B$) of the reaction mixture (A+B) to the melt viscosity ($\eta A$) of the thermoplastic polyurethane (A) is in a range from 0.7 to 12.0.

5. The golf ball according to claim 1, wherein a polyol component constituting the urethane prepolymer (B) has a number average molecular weight of 650 or more.

6. The golf ball according to claim 1, wherein a polyol component constituting the urethane prepolymer (B) has a number average molecular weight from 650 to 3000.

7. The golf ball according to claim 1, wherein the cover composition has a slab hardness of from 20 to 60 in Shore D hardness.

8. The golf ball according to claim 1, wherein the thermoplastic polyurethane (A) has a flow beginning temperature ($T_A$) from 100° C. to 210° C.

9. The golf ball according to claim 1, wherein the thermoplastic polyurethane (A) has a melt viscosity (ηA) at 210° C. from 1,000 P to 45,000 P.

10. A golf ball comprising a core and a cover, wherein the cover is formed from a cover composition that contains, as a resin component, only a reaction mixture (A+B) obtained by melt-mixing a thermoplastic polyurethane (A) and a urethane prepolymer (B) having two or more isocyanate groups in an amount of 1 part to 50 parts with respect to 100 parts of the thermoplastic polyurethane (A) by mass, the thermoplastic polyurethane (A) has a flow beginning temperature ($T_A$) from 100° C. to 210° C., and a melt viscosity (ηA) at 210° C. from 1,000 P to 45,000 P, and the urethane prepolymer (B) has a NCO content from 2.0 mass % to 7.0 mass %.

11. The golf ball according to claim 10, wherein a polyol component constituting the urethane prepolymer (B) has a number average molecular weight from 650 to 3000.

12. A process for manufacturing a golf ball having a core and a cover covering the core, comprising mixing a thermoplastic polyurethane (A) and a urethane prepolymer (B) having two or more isocyanate groups to form a reaction mixture (A+B), wherein the urethane prepolymer (B) has a NCO content from 2.0 mass % to 7.0 mass %, preparing a cover composition comprising, as a resin component, only the reaction mixture (A+B), and molding the cover composition into the cover.

13. The process for manufacturing the golf ball according to claim 12, wherein the mixing is conducted by feeding the thermoplastic polyurethane (A) into a extruder, and subsequently side-feeding the urethane prepolymer (B) into the feed of the thermoplastic polyurethane (A).

14. The process for manufacturing the golf ball according to claim 12, further comprising post curing the molded cover.

15. The process for manufacturing the golf ball according to claim 14, wherein the post curing is conducted at a temperature of 40° C. or more for 4 hours to 96 hours.

* * * * *